US007189151B2

(12) United States Patent
Takeuchi et al.

(10) Patent No.: US 7,189,151 B2
(45) Date of Patent: Mar. 13, 2007

(54) EMBEDDING TOOL DESIGNED TO EMBED GRAINS INTO FACEPLATE FOR LAPPING APPARATUS

(75) Inventors: Mitsuo Takeuchi, Kawasaki (JP); Yoshiaki Yanagida, Kawasaki (JP); Tomokazu Sugiyama, Ashikaga (JP); Tsutomu Sooda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 41 days.

(21) Appl. No.: 10/878,065

(22) Filed: Jun. 28, 2004

(65) Prior Publication Data

US 2004/0235404 A1 Nov. 25, 2004

Related U.S. Application Data

(63) Continuation of application No. PCT/JP01/11586, filed on Dec. 27, 2001.

(51) Int. Cl.
*B24B 5/00* (2006.01)

(52) U.S. Cl. ..... 451/259; 451/285

(58) Field of Classification Search ..... 451/285, 451/287, 288, 8, 278, 279, 387, 389, 405, 451/259, 272, 273

See application file for complete search history.

(56) References Cited

U.S. PATENT DOCUMENTS

| | | | | |
|---|---|---|---|---|
| 5,899,793 | A | 5/1999 | Yanagida et al. | 451/8 |
| 6,325,699 | B1 | 12/2001 | Sudo et al. | 451/8 |
| 6,602,108 | B2 * | 8/2003 | Griffin et al. | 451/5 |
| 6,769,969 | B1 * | 8/2004 | Duescher | 451/59 |
| 2003/0150169 | A1 * | 8/2003 | Annen | 51/300 |
| 2004/0237414 | A1 * | 12/2004 | Ohnishi | 51/309 |
| 2005/0176351 | A1 * | 8/2005 | Singh | 451/28 |

FOREIGN PATENT DOCUMENTS

| | | |
|---|---|---|
| JP | 2-65966 | 3/1990 |
| JP | 6-304860 | 11/1994 |
| JP | 9-245333 | 9/1997 |
| JP | 10-134316 | 5/1998 |
| JP | 10-249714 | 9/1998 |
| JP | 10-286767 | 10/1998 |
| JP | 10-296620 | 11/1998 |
| JP | 2000-24914 | 1/2000 |
| JP | 2000-158312 | 6/2000 |
| JP | 2000-296456 | 10/2000 |
| JP | 2000-354952 | 12/2000 |
| JP | 2001-232558 | 8/2001 |

* cited by examiner

*Primary Examiner*—Jacob K. Ackun, Jr.
(74) *Attorney, Agent, or Firm*—Greer, Burns & Crain, Ltd.

(57) ABSTRACT

A pad of an embedding tool is received on a faceplate. The pad is supported on a support member. When the embedding tool is urged against the surface of the faceplate, the pad is allowed to change the attitude relative to the support member in response to undulation generated on the surface of the faceplate. The movement of the flat surface follows the undulation of the faceplate. When a relative movement is induced between the embedding tool and the surface of the faceplate, the surface of the faceplate thus reliably receives the uniform or constant contact of the flat surface. When grains are supplied between the flat surface of the pad and the surface of the faceplate, the grains are uniformly pushed into the surface of the faceplate. In this manner, the grains are uniformly and constantly embedded into the surface of the faceplate.

8 Claims, 5 Drawing Sheets

EMBEDDING TOOL DESIGNED TO EMBED GRAINS INTO FACEPLATE FOR LAPPING APPARATUS

This is a continuation of International PCT Application No. PCT/JP01/11586, tiled Dec. 27, 2001.

BACKGROUND OF THE INVENTION

1. Field of the Invention

The present invention relates to a lapping apparatus holding grains over the surface of a faceplate, namely a grinding surface. In particular, the present invention relates to an embedding tool designed to embed grains into the faceplate in the lapping apparatus.

2. Description of the Prior Art

A lapping apparatus utilizing fixed grains is well known. The grains are embedded in the surface of a faceplate, namely a grinding surface, prior to lapping process in the lapping apparatus. A ring member harder than the faceplate is employed to realize the embedment of the grains. An annular flat surface is defined on the ring member. The annular flat surface is designed to have the diameter equal to the radius of the faceplate or grinding surface, for example. The flat surface of the ring member is urged against the grinding surface. Grains are then applied to the grinding surface. When a relative movement is induced between the ring member and the grinding surface, the ring member functions to embed the grains into the grinding surface.

In general, the faceplate includes a disk made of tin defining the grinding surface, and an iron support member backing the disk. Tin and iron have different coefficients of thermal expansion, so that a slight temperature change such as a change of one or two degrees Celsius induces undulation over the grinding surface of the faceplate. The undulation has amplitude in the order of several to several hundred micrometers, for example. The undulation of the grinding surface causes a space or gap partially between the flat surface of the ring member and the grinding surface of the faceplate. The embedment of minute grains cannot reliably be achieved in the gap. The grinding surface thus suffers from uneven distribution of the grains. If the resulting faceplate is employed in the lapping process, the quantity or degree of progress of the grinding cannot be controlled at a higher accuracy.

SUMMARY OF THE INVENTION

It is accordingly an object of the present invention to provide an embedding tool designed to uniformly embed grains into a faceplate for a lapping apparatus.

According to a first aspect of the present invention, there is provided an embedding tool for a lapping apparatus, comprising: a pad having a flat surface to be received on a faceplate of the lapping apparatus; and a support member supporting the pad. The support member is designed to apply to the pad an urging force toward the faceplate. The attitude of the pad is changeable relative to the faceplate. Here, the pad is normally made harder than the faceplate.

When the embedding tool is urged against the surface of the faceplate, the pad is allowed to change the attitude relative to the support member in response to undulation generated on the surface of the faceplate. The movement of the flat surface follows the undulation of the faceplate. When a relative movement is induced between the embedding tool and the surface of the faceplate, the surface of the faceplate thus reliably receives the uniform or constant contact of the flat surface. On the other hand, if the attitude of the flat surface is fixed in the conventional manner, the undulation of the faceplate causes a space or gap partially between the flat surface and the surface of the faceplate. In this case, even if a relative movement is induced between the embedding tool and the surface of the faceplate, the surface of the faceplate cannot enjoy the uniform or constant contact from the flat surface.

When grains are supplied between the flat surface of the pad and the surface of the faceplate, for example, the grains are uniformly pushed into the surface of the faceplate. In this manner, the grains are uniformly and constantly embedded into the surface of the faceplate. If the resulting fixed grains are employed to realize lapping process, it is possible to control the quantity or degree of progress of the grinding at a higher accuracy.

An elastic member may be interposed between the support member and the pad so as to realize the change of the attitude of the pad. The elasticity of the elastic member allows the pad to reliably achieve the change of the attitude. Moreover, the elastic member serves to reliably transmit the urging force to the pad from the support member.

A groove may be defined in the flat surface of the pad. The groove functions to establish a vertical surface, perpendicular to the surface of the faceplate, in the flat surface of the pad. A ridge is thus defined between the vertical surface and the flat surface. The ridge is allowed to move along the surface of the faceplate. The ridge and/or the vertical surface serve to efficiently push the grains into the surface of the faceplate. The embedment of the grains can be achieved in a shorter time duration. The groove may be defined on the flat surface along a lattice pattern, for example.

The above-described embedding tool can be assembled in a lapping apparatus, for example. The lapping apparatus may include a faceplate defining a grinding surface; a support member disposed for relative movement relative to the grinding surface; and a pad held on the support member. The pad has a flat surface urged against the grinding surface. The attitude of the pad is changeable relative to the grinding surface. The lapping apparatus may further comprise a jig disposed for relative movement relative to the grinding surface so as to hold an object subjected to lapping process. Still furthermore, the lapping apparatus may include: a rotating mechanism designed to drive the faceplate for rotation around a rotation axis; and a reciprocating mechanism designed to move the jig along a straight line defined on the faceplate.

According to a second aspect of the present invention, there is provided an embedding tool for a lapping apparatus, comprising: a support member to be opposed to a faceplate of the lapping apparatus; block members supported on the support member at locations spaced from each other with a gap, block members defining flat surfaces, respectively; and grooves defined on the flat surfaces of the block members, said grooves having a width smaller than the width of the gap.

When grains are supplied between the flat surfaces of the block members and the surface of the faceplate, for example, the grains are pushed into the surface of the faceplate. In this case, the groove functions to establish a vertical surface, perpendicular to the surface of the faceplate, in the flat surfaces of the block members. Ridges are thus defined between the vertical surfaces and the flat surfaces. The ridges are allowed to move along the surface of the faceplate. The ridges and/or the vertical surfaces serve to efficiently push the grains into the surface of the faceplate. The embedment of the grains can be achieved in a shorter time duration. The groove may be defined on the flat surface along a lattice pattern, for example.

BRIEF DESCRIPTION OF THE DRAWINGS

The above and other objects, features and advantages of the present invention will become apparent from the following description of the preferred embodiments in conjunction with the accompanying drawings, wherein.

DESCRIPTION OF THE PREFERRED EMBODIMENTS

Figure 1:
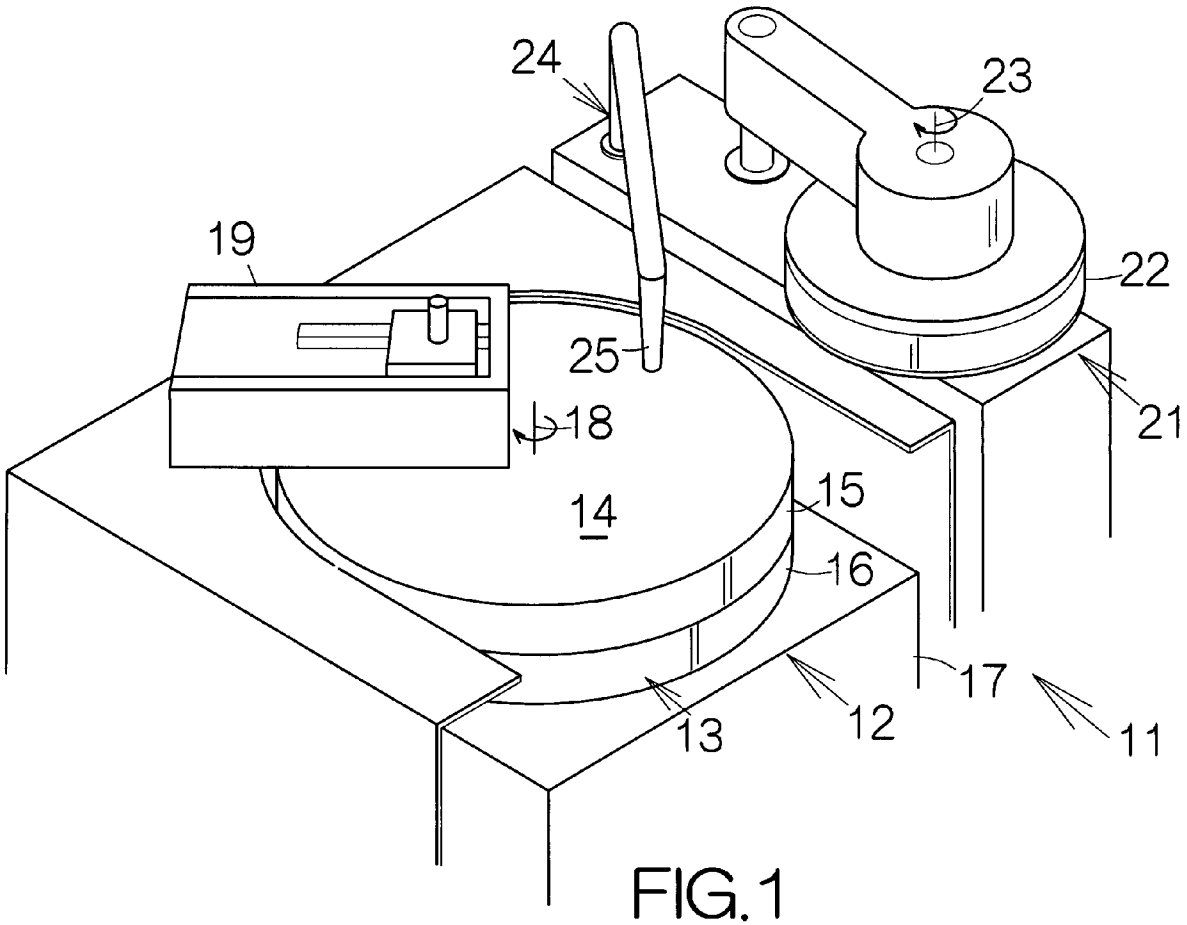
FIG. 1 is a perspective view schematically illustrating the overall structure of a lapping apparatus.

As shown in FIG. 1, a lapping apparatus 11 includes a grinding unit 12. A faceplate 13 is assembled in the grinding unit 12. The faceplate 13 has the diameter ranging from 300 mm to 400 mm approximately. The faceplate 13 includes a disk 15 defining a flat grinding surface 14 on the upper surface, and a support member 16 attached to the back of the disk 15. The disk 15 is made of a soft metallic material. The disk 15 may be made of tin, for example. The support member 16 is made of a relatively hard metallic material such as iron, a stainless steel, or the like. The disk 15 as well as the support member 16 may have the thickness of 20 mm approximately, for example.

A rotating mechanism 17 is connected to the faceplate 13. The rotating mechanism 17 is designed to drive the faceplate for rotation around a vertical axis 18, for example. The rotating mechanism 17 is allowed to drive the faceplate at various rotation speeds based on the operation of a drive source such as a motor and a transmission, both not shown.

A jig unit 19 is opposed to the grinding surface 14 of the faceplate 13. The jig unit 19 is designed to urge an object, to be subjected to lapping process, against the grinding surface 14. The jig unit 19 is allowed to reciprocate the object along the radial line of the faceplate 13. The jig unit 19 will be described later in detail.

The lapping apparatus 11 further includes an embedding unit 21. The embedding unit 21 includes an embedding tool 22 designed to embed grains into a faceplate for a lapping apparatus. The embedding tool 22 is opposed to the grinding surface 14 of the faceplate 13. The embedding tool 22 is allowed to rotate around a vertical axis 23. A drive source such as a motor, not shown, is connected to the embedding tool 22 so as to drive the embedding tool 22 for rotation, for example. As is apparent from FIG. 1, the embedding tool 22 can retreat out of a space right above the grinding surface 14.

A slurry supply mechanism 24 is incorporated in the embedding unit 21. The slurry supply mechanism 24 includes a supply tube 25 designed to discharge slurry containing abrasion grains toward the grinding surface 14. The slurry may comprise a dispersion medium such as water, and grains such as diamonds particles dispersed in the dispersion medium, for example. The diameter of the grains is set in a range between 0.1 μm and 0.4 μm approximately. A pump, not shown, may be employed to supply the slurry to the supply tube 25 from a reservoir, not shown.

Figure 2:
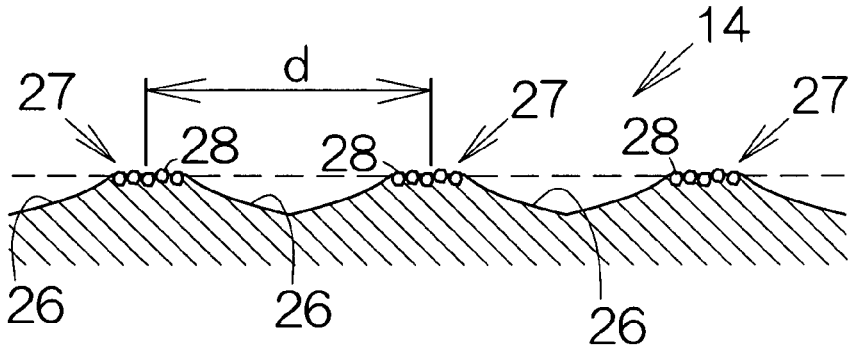
FIG. 2 is an enlarged partial sectional view of a faceplate for illustrating a grinding surface cut out along the radial line of the faceplate.

As shown in FIG. 2, concentric grooves 26 are formed on the grinding surface 14 of the faceplate 13 around the vertical axis 18. Banks 27 are defined between the adjacent grooves 26, for example. The banks 27 are designed to have a flat top surface. Grains 28 are embedded in the top surfaces of the banks 27. The interval d ranging from 0.1 mm to 0.2 mm approximately is set between the banks 27, for example.

Figure 3:
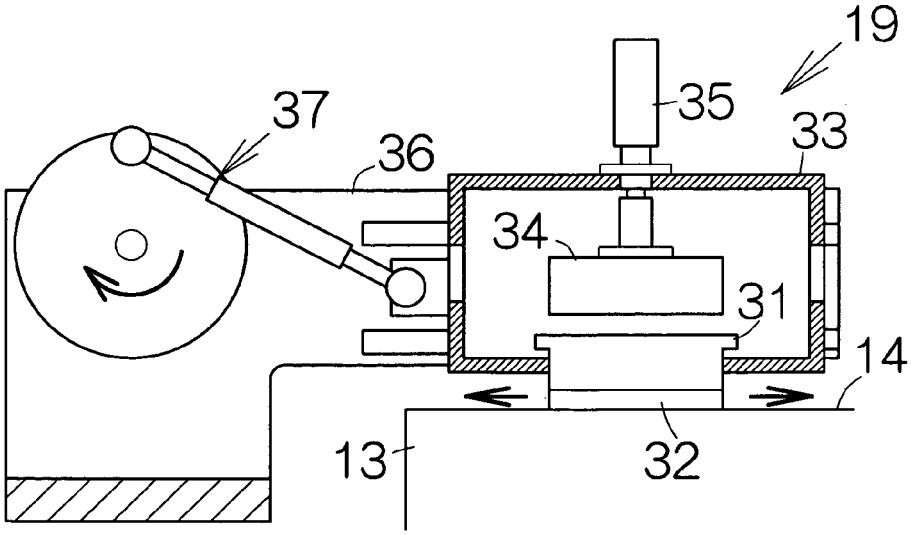
FIG. 3 is a schematic view illustrating the structure of a jig unit.

As shown in FIG. 3, the jig unit 19 includes a jig 31. The jig 31 has a downward attachment surface opposed to the grinding surface 14 of the faceplate 13. The jig 31 is designed to hold the object 32, to be subjected to lapping process, at the attachment surface. The jig 31 is supported on a support member 33. The jig 31 is movable in tridimensional directions.

A weight 34 is mounted on the jig 31. The weight 34 urges the jig 31 against the grinding surface 14 based on the gravity. The weight 34 serves to urge the object 32 against the grinding surface 14. A pressurizing cylinder 35 is connected to the weight 34. The pressurizing cylinder 35 generates a driving force for moving the weight 34 upward and downward in the vertical direction. This upward and downward movement enables adjustment on the magnitude of the urging force acting on the jig 31 from the weight 34. The pressurizing cylinder 35 is supported on the support member 33.

The jig unit 19 includes an outer frame 36 extending from the outer periphery of the faceplate 13 toward the center of the faceplate 13, for example. The outer frame 36 is designed to guide a horizontal movement of the support member 33 along the radial line of the faceplate 13. A crank mechanism 37 is connected to the support member 33. The crank mechanism 37 serves to cause the horizontal movement of the support member 33. The outer frame 36 and the crank mechanism 37 in combination establish a reciprocating mechanism according to the present invention.

Figure 4:
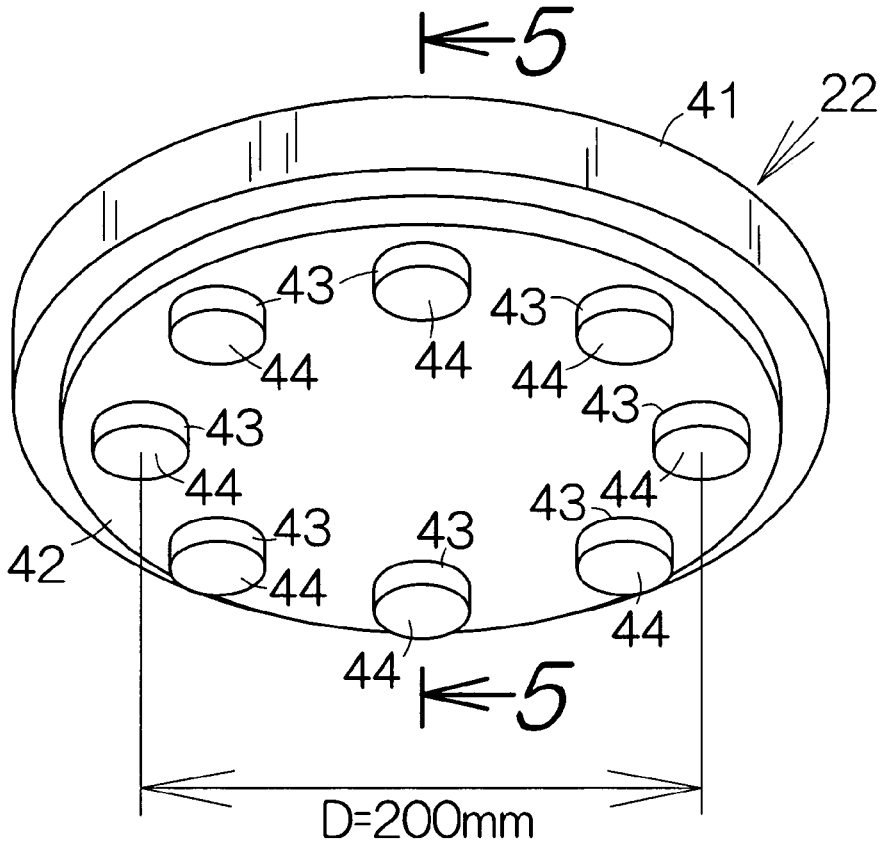
FIG. 4 is an enlarged perspective view illustrating an embedding tool.

As shown in FIG. 4, the embedding tool 22 includes a disk or support member 41 made of a stainless steel, for example. A disk-shaped elastic member 42 is attached to the downward surface of the support member 41. The elastic member 42 may be made of a rubber sheet. Pads 43 are located on the surface of the elastic member 42. The pads 43 are arranged along a circle around the vertical axis 23 at equal intervals. The circle may have the diameter equal to the radius of the faceplate 14, namely 200mm approximately, for example. The pads 43 are made to have a hardness larger than that of the faceplate 13. The pads 43 may accordingly be made of a hard material such as $Al_2O_3$-TiC. Since the elastic member 42 is interposed between the pads 43 and the support member 41, the pads 43 are allowed to easily change the attitude relative to the support member 41 based on elasticity of the elastic member 42. It should be noted that the elastic member 42 needs not spread all over the surface of the support member 41, and may at least locally be interposed between the individual pads 43 and the support member 41.

A downward flat surface 44 is defined on the individual pad 43. The flat surface 44 is designed to have a surface roughness Ra equal to or smaller than 0.1 μm, for example. The diameter of the flat surface 44 may be set at 14 mm, for example. The flat surface 44 of the pad 43 is opposed to the grinding surface 14 of the faceplate 13. At least the flat surface 44 in the pad 43 may have hardness harder than the grinding surface 14 of the faceplate 13. The diameter of the flat surface 44 is preferably set smaller than the distance between the maximum peak and the deepest valley in undulation formed on the grinding surface 14.

Figure 5:
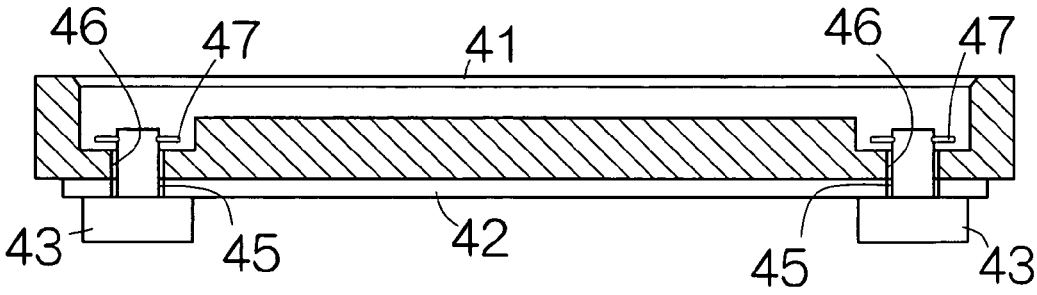
FIG. 5 is a sectional view taken along the line 5–5 in FIG. 4.

Referring also to FIG. 5, an attachment shaft 45 is fixed to the upward surface of the individual pad 43. The attachment shaft 45 is received in a through hole 46 defined throughout the elastic member 42 and the support member 41. A predetermined lash or clearance is defined between the inner wall surface of the through hole 46 and the attachment shaft 45. An engaging member 47 such as a so-called E-ring is attached to the tip end of the attachment shaft 45. The engaging member 47 serves to prevent the pad 43 from falling off from the support member 41. The individual pads 43 are in this manner held on the support member 41.

Now, assume that a raw bar including magnetic head elements in a row is to be subjected to lapping process. The raw bar is cut out from a disk-shaped wafer. Magnetic head elements are formed on the wafer in a matrix. The raw bar is cut out from the wafer so as to include a row of the magnetic head elements out of the matrix. A head slider is cut out from the raw bar so as to include one of the magnetic head elements in a row. The head slider of the type is employed in a hard disk drive (HDD), for example.

First of all, the raw bar is attached to the jig 31 at the attachment surface. An elastic material such as a rubber sheet is interposed between the attachment surface and the raw bar, for example. The jig 31 is then set in the jig unit 19. A lubricant of a predetermined amount is applied to the grinding surface 14 of the faceplate 13. The jig 31 is thereafter moved in the horizontal direction with the assistance of the crank mechanism 37. The raw bar is forced to reciprocate along the grinding surface 14 on the radial line of the faceplate 13. Simultaneously, the rotating mechanism 17 starts the rotation of the faceplate 13. The speed of the jig 31 is set in a range from 3 m/min to 5 m/min approximately, for example. The rotation speed of the faceplate 13 is set in a range between 0.5 rpm and 1.0 rpm approximately, for example.

The pressurizing cylinder 35 lifts the weight 34 above the jig 31 during first ten seconds, for example, from the beginning of the reciprocation of the jig 31. Specifically, the raw bar is designed to receive a reduced urging force at the beginning of the lapping process. The surface of the raw bar gets harmonized with the grinding surface during this time duration. If the raw bar is heavily urged against the grinding surface before it gets harmonized with the grinding surface, the raw bar may suffer from large scratches that cannot be recovered thereafter.

The weight 34 is subsequently set on the jig 31. The raw bar is urged against the grinding surface 14 with an urging force of a predetermined magnitude. The surface of the raw bar is thus subjected to grinding. The rotation speed of the faceplate 13 is set remarkably smaller than the speed of the jig 31, so that the grinding is effected on the surface of the raw bar only along a predetermined direction.

When the lapping process is to be finished, the weight 34 is first removed from the jig 31 with the assistance of the pressurizing cylinder 35. The urging force to the raw bar is again reduced. The rotating mechanism 17 subsequently stops the rotation of the faceplate 13. The reciprocation of the jig 31 is then terminated.

Figure 6:
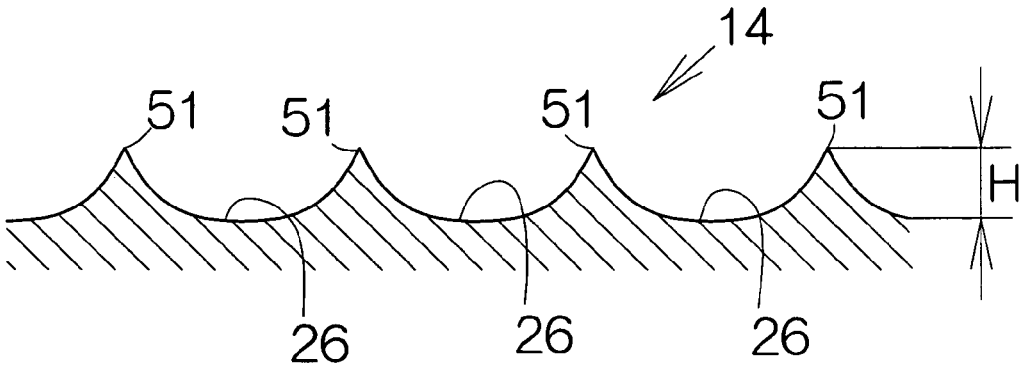
FIG. 6 is an enlarged partial sectional view of the faceplate for schematically illustrating the grinding surface after a facing process.

The lapping apparatus 11 executes a process of embedding grains prior to the above-described lapping process. The embedding process starts with a so-called facing process. A grinding bit is first applied to the grinding surface 14 of the faceplate 13. The aforementioned grooves 26 are defined on the grinding surface 14 as the faceplate 13 rotates. As is apparent from FIG. 6, sharp ridges 51 are established between the adjacent grooves 26 in this case. The height H of the ridges 51 is set in a range between 4.0 μm and 6.0 μm approximately, for example. The height H may be measured between the bottom of the groove 26 and the apex of the ridge 51.

When the facing process have been completed, the slurry supply mechanism 24 starts supplying the slurry onto the grinding surface 14 of the faceplate 13. The rotating mechanism 17 drives the faceplate 13 for rotation during the supply of the slurry. The rotation speed of the faceplate 13 may be set at 20 rpm approximately, for example.

The embedding tool 22 is set on the grinding surface 14 of the rotating faceplate 13. The embedding tool 22 is also driven for rotation around the vertical axis 23 at the rotation speed of 20 rpm approximately. The attitude of the vertical axis 23 is fixed. The pads 43 are urged against the grinding surface 14 with the assistance of the gravity of the support member 41 and/or a weight, not shown. The support member 41 serves to apply to the individual pads 43 the urging force toward the faceplate 13.

Figure 7:
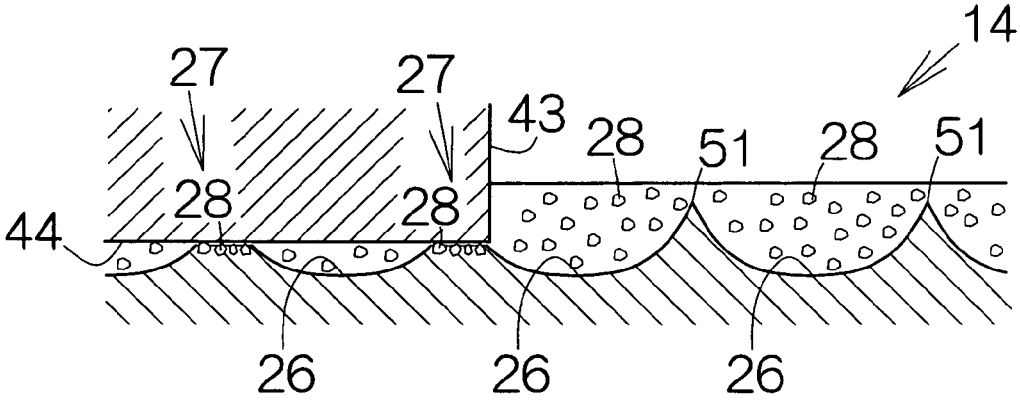
FIG. 7 is a schematic view illustrating the function of the embedding tool.

When a relative movement is induced between the flat surfaces 44 of the pads 43 and the grinding surface 14, the flat surfaces 44 of the pads 43 function to chip the ridges 51, as shown in FIG. 7. The apices of the ridges 51 are thus flattened, so that the ridges 51 are transformed into the aforementioned banks 27 between the adjacent grooves 26. At the same time, the flat surfaces 44 of the pads 43 serve to push the grains 28 contained in the slurry within the grooves 26. In particular, the grains 28 are thus embedded into the top surfaces of the banks 27. The fixed grains are established in this manner. The urging of the embedding tool 22 is maintained for tow hours approximately, for example.

Figure 8:
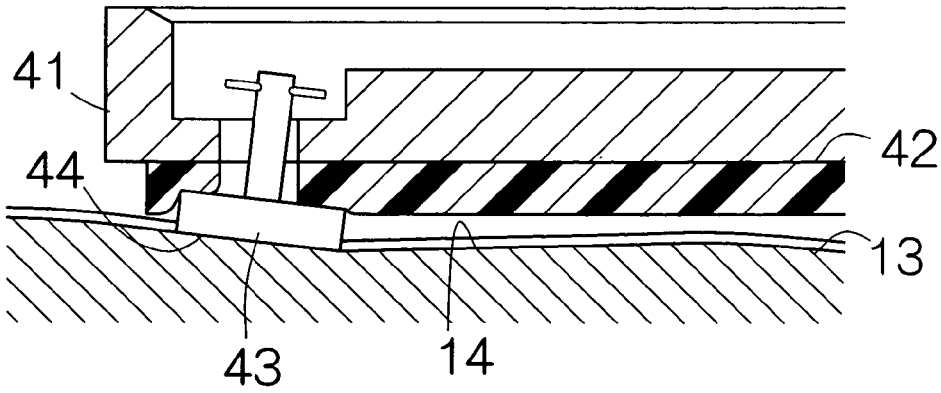
FIG. 8 is a schematic view illustrating the movement of the pad.

When the aforementioned bimetallic faceplate 13 suffers from a slight temperature change such as a change of one or two degrees Celsius, undulation is induced over the grinding surface 14 of the faceplate 13 based on different coefficients of thermal expansion. The undulation has amplitude in the order of several to several hundred micrometers, for example. In this case, the pads 43 are allowed to change the attitude relative to the support member 41, as shown in FIG. 8, while the attitude of the vertical axis 23 and the support member 41 is fixed. The movement of the flat surfaces 44 follows the undulation on the grinding surface 14. The grinding surface 14 of the faceplate 13 thus reliably receives the uniform or constant contact of the flat surfaces 44. In this manner, the grains 28 are uniformly and constantly embedded into the grinding surface 14. If the resulting grinding surface 14 is employed to realize the aforementioned lapping process, it is possible to control the quantity or degree of progress of the grinding at a higher accuracy.

Figure 9:
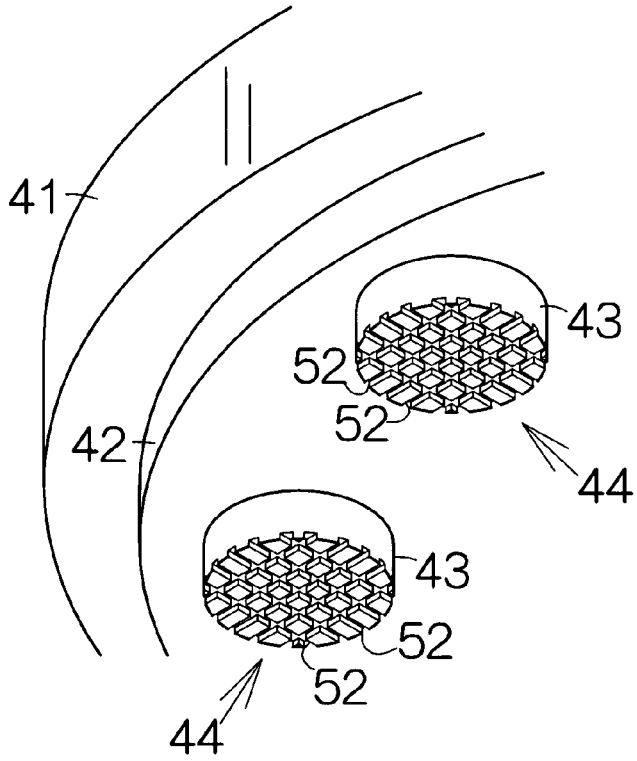
FIG. 9 is an enlarged partial perspective view of the embedding tool according to another embodiment.
Figure 10:
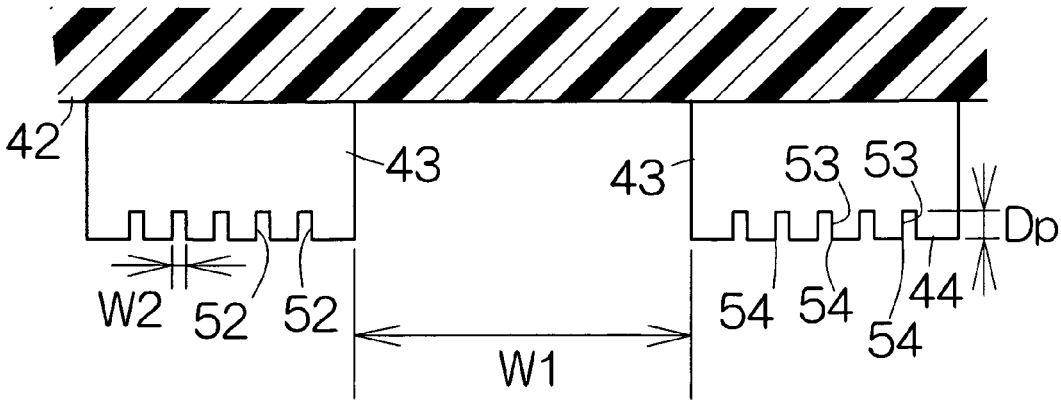
FIG. 10 is an enlarged partial sectional view of the embedding tool according to the embodiment of FIG. 9.

Otherwise, a groove 52 may be formed on the flat surface 44 of the individual pad 43, as shown in FIG. 9, for example. The groove 52 may be allowed to extend along a lattice pattern. The groove 52 may have a width W2 smaller than the width W1 of a gap between the adjacent pads 43 or block members, as is apparent from FIG. 10. The depth Dp of the groove 52 may be set at 1 mm approximately, for example.

The groove 52 functions to establish vertical surfaces 53, perpendicular to the grinding surface 14, in the flat surface 44 of the pad 43. Ridges 54 are thus defined between the vertical surfaces 53 and the flat surface 44. The ridges 54 are allowed to move along the grinding surface 14. The ridges 54 and/or the vertical surfaces 53 serve to efficiently push the grains 28 into the grinding surface 14. The embedment of the grains 28 can thus be achieved in a shorter time duration.

It should be noted that any object other than the aforementioned raw bar can be subjected to the aforementioned lapping process. Otherwise, the aforementioned embedding unit 21 can be separated from the lapping apparatus 11.

What is claimed is:

1. An embedding tool for a lapping apparatus, comprising:

a pad made of a hard material and having a flat surface to be received on a faceplate;

an attachment shaft fixed to the pad;

a support member defining a through hole for receiving the attachment shaft so as to support the pad, a predetermined lash being defined between an inner surface of the through hole and the attachment shaft, said support member applying to the pad an urging force toward the faceplate; and an elastic member interposed between the support member and the pad for changing an attitude of the pad relative to the faceplate.

2. The embedding tool according to claim 1, wherein a groove is defined in the flat surface.

3. The embedding tool according to claim 2, wherein said groove is defined along a lattice pattern.

4. A lapping apparatus comprising:

a faceplate defining a grinding surface;

a support member disposed for relative movement relative to the grinding surface, said support member defining a through hole;

a pad made of a hard material and having a flat surface urged against the grinding surface;

an attachment shaft fixed to the pad, said attachment shaft received in the through hole for supporting the pad on the support member, a predetermined lash being defined between an inner surface of the through hole and the attachment shaft; and an elastic member interposed between the support member and the pad for changing an attitude of the pad relative to the grinding surface.

5. The lapping apparatus according to claim 4, further comprising a jig disposed for relative movement relative to the grinding surface so as to hold an object subjected to lapping process.

6. The lapping apparatus according to claim 4, wherein a groove is defined in the flat surface.

7. The lapping apparatus according to claim 6, wherein said groove is defined along a lattice pattern.

8. The lapping apparatus according to claim 4, further comprising:

a rotating mechanism designed to drive the faceplate for rotation around a rotation axis; and a reciprocating mechanism designed to move the jig along a straight line defined on the faceplate.

* * * * *